US012404131B2

(12) United States Patent
Samaras et al.

(10) Patent No.: US 12,404,131 B2
(45) Date of Patent: Sep. 2, 2025

(54) CONTINUOUS DISPENSING REEL SYSTEM

(71) Applicant: ILLINOIS TOOL WORKS INC., Glenview, IL (US)

(72) Inventors: Christopher J. Samaras, Tinley Park, IL (US); Kevin D. Erickson, Glen Ellyn, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 686 days.

(21) Appl. No.: 17/778,630

(22) PCT Filed: Oct. 12, 2020

(86) PCT No.: PCT/US2020/055192
§ 371 (c)(1),
(2) Date: May 20, 2022

(87) PCT Pub. No.: WO2021/118680
PCT Pub. Date: Jun. 17, 2021

(65) Prior Publication Data

US 2023/0028632 A1 Jan. 26, 2023

Related U.S. Application Data

(60) Provisional application No. 62/947,822, filed on Dec. 13, 2019.

(51) Int. Cl.
*B65H 16/02* (2006.01)
*B65D 71/50* (2006.01)
(Continued)

(52) U.S. Cl.
CPC ..... *B65H 16/021* (2013.01); *B65D 85/67* (2013.01); *B65H 18/28* (2013.01); *B65D 71/504* (2013.01);
(Continued)

(58) Field of Classification Search
CPC .... B65H 16/005; B65H 16/021; B65H 16/04; B65H 18/28; B65H 75/02; B65H 75/08;
(Continued)

(56) References Cited

U.S. PATENT DOCUMENTS 2,650,703 A * 9/1953 Hagen ..... A47L 13/04 206/393
3,285,405 A 11/1966 Wanderer
(Continued)

FOREIGN PATENT DOCUMENTS

DE 37 02 595 A1 8/1988
EP 0 960 833 A1 12/1999
(Continued)

OTHER PUBLICATIONS

European Patent Office (EPO), Rijswijk, NL, International Search Report, Form PCT/ISA/210 for International Application No. PCT/US2020/055192, Feb. 18, 2021 (5 pp.).
(Continued)

*Primary Examiner* — Anna M Momper
*Assistant Examiner* — Raveen J Dias
(74) *Attorney, Agent, or Firm* — Pauley Erickson & Swanson

(57) ABSTRACT

A generally continuous string of container carriers are positioned on a base (35) wherein container carriers are housed on multiple reels (40) and are spliced together between adjacent reels to form the generally continuous string and the multiple reels are arranged on at least one axle (55) for dispensing.

21 Claims, 5 Drawing Sheets

(51) Int. Cl.
*B65D 85/67* (2006.01)
*B65H 18/28* (2006.01)

(52) U.S. Cl.
CPC ..... *B65D 2519/00631* (2013.01); *B65H 2301/412845* (2013.01)

(58) Field of Classification Search
CPC .... B65H 75/10; B65H 75/362; B65H 75/364; B65H 75/4471; B65H 2301/4128; B65H 2301/41282; B65H 2301/41284; B65H 2301/412845; B65D 85/02; B65D 85/66; B65D 85/67; B65D 85/671; B65D 85/672; B65D 85/675; B65D 85/676; B65D 71/00; B65D 71/02; B65D 71/50; B65D 71/504; B65D 71/506
USPC ..... 242/570, 570.2, 159, 160, 160.1, 160.2, 242/160.3, 571.2
See application file for complete search history.

(56) References Cited

U.S. PATENT DOCUMENTS 3,611,656 A * 10/1971 Chidsey, Jr. ..... B65D 71/50 206/145
3,710,535 A * 1/1973 Walter ..... B65B 17/025 53/558
3,878,663 A * 4/1975 Shelton ..... B65B 15/04 53/399
4,022,396 A * 5/1977 Manchester ..... B65H 75/26 242/129
4,033,457 A * 7/1977 Weaver ..... B65D 85/67 206/390
4,267,985 A 5/1981 Rogers
4,741,729 A * 5/1988 Edwards ..... B65D 71/504 294/87.2
4,844,360 A * 7/1989 Winter ..... B65H 16/021 211/171
4,955,471 A * 9/1990 Hirose ..... B65H 18/28
5,125,506 A * 6/1992 Galbierz ..... B65B 17/025 206/151
5,303,823 A * 4/1994 Niles ..... B65D 43/162
5,310,056 A * 5/1994 Ball ..... B65D 33/002 206/390
5,551,563 A * 9/1996 Allen ..... B65H 49/38 206/394
5,987,851 A * 11/1999 O'Connor ..... B65D 85/67 53/436
6,068,125 A 5/2000 Slaters, Jr. et al.
6,209,814 B1 * 4/2001 Helton ..... B65H 55/04 242/531
8,418,844 B2 * 4/2013 Slaters, Jr. ..... B65D 71/504 206/427
9,139,335 B2 * 9/2015 Mansson ..... B65D 71/0096
9,434,521 B2 * 9/2016 Olsen ..... B65D 85/67
10,053,321 B2 * 8/2018 Erdem ..... B65H 18/28
10,087,027 B2 * 10/2018 Takeda ..... B65H 21/00
11,945,631 B2 * 4/2024 Cyr ..... B65D 65/466
2002/0144924 A1 * 10/2002 Johnson ..... B65D 85/67 156/204
2003/0122008 A1 * 7/2003 Abba ..... B65H 19/10 242/593
2003/0122009 A1 * 7/2003 Abba ..... B65H 19/10 242/167
2009/0166235 A1 * 7/2009 Mansson ..... B65D 71/04 206/391
2010/0140121 A1 * 6/2010 Slaters, Jr. ..... B65D 71/504 206/223
2010/0320309 A1 * 12/2010 Galgano ..... B65D 85/676 229/199
2011/0259767 A1 * 10/2011 Olsen ..... B65D 85/67 206/150
2014/0196634 A1 * 7/2014 Mansson ..... B65D 85/672 108/55.1
2016/0016351 A1 * 1/2016 Siewert ..... B29C 53/02 264/163
2016/0280490 A1 * 9/2016 Erdem ..... A61F 13/15764
2023/0087274 A1 * 3/2023 Cyr ..... B65D 71/50 294/87.2
2024/0091972 A1 * 3/2024 Hayter ..... B65D 71/50

FOREIGN PATENT DOCUMENTS

GB 727158 A * 3/1955 ..... B65D 85/672
WO WO-2014173757 A1 * 10/2014 ..... B65D 19/44
WO WO-2018230494 A1 * 12/2018 ..... B65H 16/04
WO WO-2020115518 A1 * 6/2020 ..... B65D 85/675

OTHER PUBLICATIONS

European Patent Office (EPO), Rijswijk, NL, Written Opinion of the Int'l Searching Authority for Int'l Appln No. PCT/US2020/055192, Form PCT/ISA/237, Feb. 18, 2021 (7 pp.).

* cited by examiner

CONTINUOUS DISPENSING REEL SYSTEM

CROSS REFERENCE TO RELATED APPLICATION

This application is a National Phase filing of PCT International Patent Application Number PCT/US2020/0551922, filed on 12 Oct. 2020, which claims the priority of U.S. Provisional Patent Application Ser. No. 62/947,822, filed 13 Dec. 2019.

These applications are hereby incorporated by reference herein in their entirety and is made a part hereof, including but not limited to those portions which specifically appear hereinafter.

BACKGROUND OF THE INVENTION

Field of the Invention

This invention relates to an apparatus and method for dispensing container carriers in a space-efficient manner.

Description of Prior Art

Container carriers are used to unitize a plurality of containers. Typical containers are bottles, cans and other containers having a sidewall and a neck, chime or raised rib around an upper portion of the container. Container carriers typically connect two or more containers into a sturdy unitized package of containers. Container carriers are generally planar arrays of rings, sometimes referred to as "six-pack carriers," and may be formed from a thermoplastic sheet material.

The thermoplastic sheet material is typically extruded and then punched so that large numbers of container carriers are formed end to end resulting in continuous elongated strings or strips of container carriers. Unless specified otherwise, container carriers as used in this specification are defined as the continuous elongated string of container carriers prior to application onto containers and subsequent division into individual container carriers.

Prior art methods of packaging container carriers involve accumulating the elongated strings of container carriers onto reels. The reels of container carriers are unwound at a later time during application onto containers. The reel method of storing and applying the container carriers to containers requires splicing the end of one reel with the beginning of the following reel without interrupting the application process. In addition, the reel method of storing and applying carriers is generally limited to reels of a size which may be physically lifted and manipulated by the applicating machine operator. Also, the reel unwinding equipment must accommodate the inertia and resultant backlash inherent in unwinding a wound strip of material. Further, the generally circular or octagonal shape of the reels limits the number of reels which may be assembled onto a single pallet for shipment between the production facility and the application facility.

According to another prior art method of storing and dispensing container carriers, such as disclosed in Wanderer, U.S. Pat. No. 3,285,405, and Slaters Jr. et al., U.S. Pat. No. 6,068,125, incorporated by reference herein, elongated strings of container carriers are fan folded, similar to pin-feed computer paper, into boxes or cartons. The container carriers are dispensed from the boxes or cartons during the application process and successive boxes or cartons containing stacks of container carriers are spliced together as the boxes empty.

However, such methods for storing and dispensing container carriers may lead to uneven accumulation of the container carriers at each end of the box or carton, specifically where the container carriers are folded over onto each other. As a result, cartons may suffer from uneven stacks of folded container carriers whereby a central portion of the carton is not filled to capacity and end portions of the carton include distinctly higher stacks of carriers. This problem is referred to as "birdsnesting" and may result in inefficiently packed cartons of container carriers and even tangling of the string of container carriers during the unwinding process. In addition, the equipment required to properly fan fold and stack container carriers into cartons is sophisticated and requires substantial investment and maintenance for continuous operation.

SUMMARY OF THE INVENTION

It is one object of this invention to provide a package of container carriers which allows for space-efficient storage of reels of container carriers and permits uninterrupted removal of a mostly continuous elongated strip of container carriers.

A package of container carriers for shipment and storage and subsequent application to groups of containers is constructed to contain reels of container carriers. Elongated strips of container carriers are preferably rolled into multiple reels and positioned and spliced within cartons for shipment and subsequent dispensing in a generally continuous manner.

A resulting package of container carriers according to an embodiment of the invention preferably includes a carton and a generally continuous string of container carriers rolled onto a plurality of reels in a generally continuous fashion wherein adjacent reels are separated by a splice.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
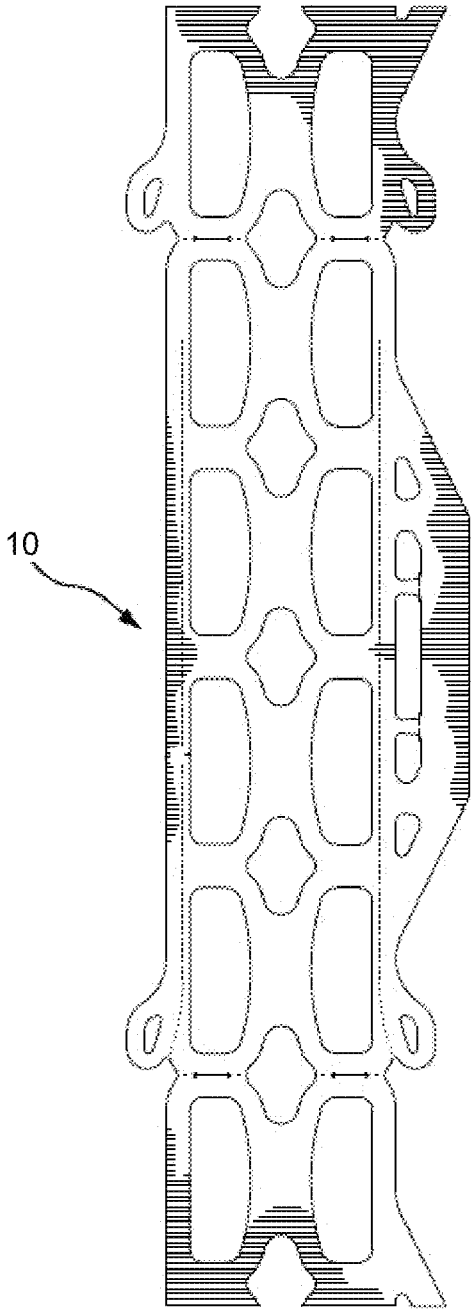
FIG. 1 (PRIOR ART)
FIG. 1 is a side elevational view of a string of container carriers according to the prior art.

FIG. 1 shows a string of container carriers 10 as the term is used in the claimed invention. Container carriers 10 are preferably arranged in a generally continuous elongated string or strip having weakened areas between adjacent individual container carriers. Individual container carriers include two or more container receiving apertures 15 which are used to engage and unitize respective groups of containers into multipackages such as six packs, twelve packs, etc.

Figure 2:
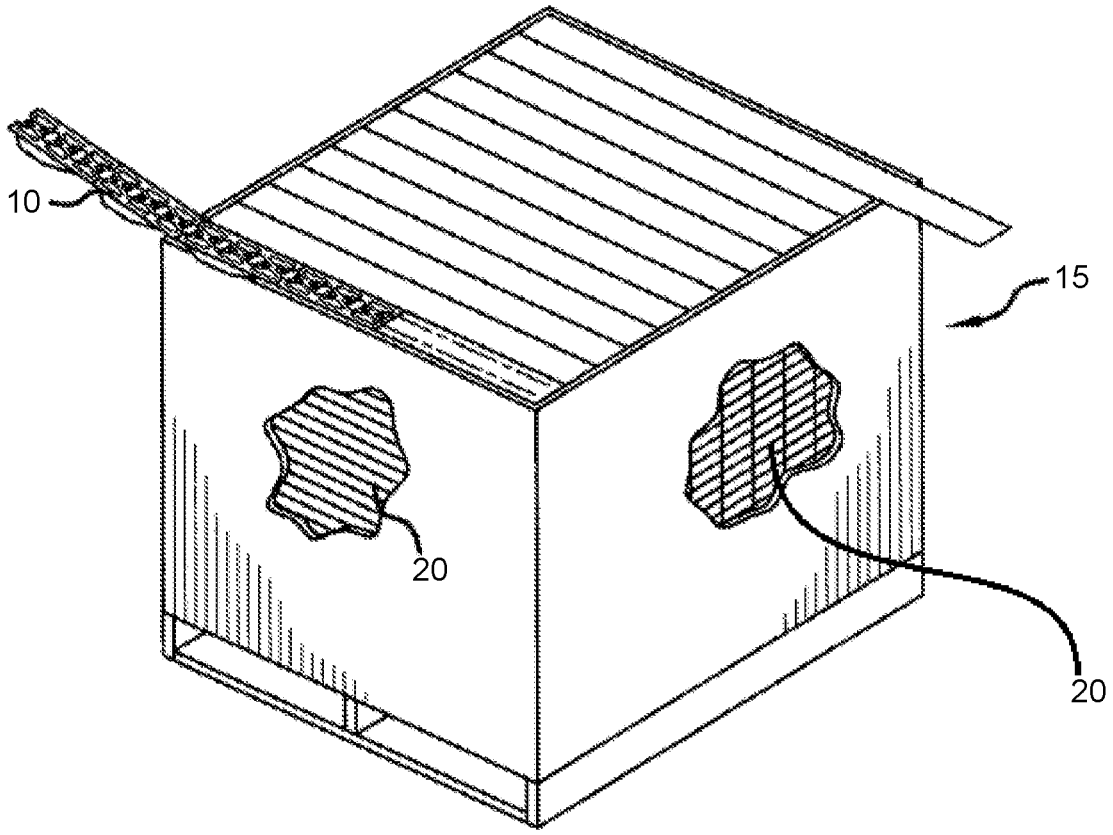
FIG. 2 (PRIOR ART)
FIG. 2 is a side perspective view of a carton or package of container carriers according to the prior art.

FIG. 2 shows a carton of fan folded stacks 20 of container carriers 10 according to the prior art. The elongated strip of container carriers 10 are preferably fan folded back and forth in alternating opposite directions resulting in horizontally extending rows of container carriers 10 forming vertically extending stacks 20. Fan folding container carriers 10, like pin-feed computer paper, preferably results in stacks 20 wherein a large amount of container carriers 10 are folded into a minimum amount of space. During the production process, container carriers 10 are preferably formed in the generally continuous, elongated string for shipment and storage in packaging, such as carton or package 15. After shipment to an application facility, such as a soft drink bottler, container carriers 10 are preferably removed from the packaging and applied, on an applicating machine, to groups of containers, such as cans, during which application container carriers 10 are separated from the elongated strip and into individual container carrier packages.

Figure 3:
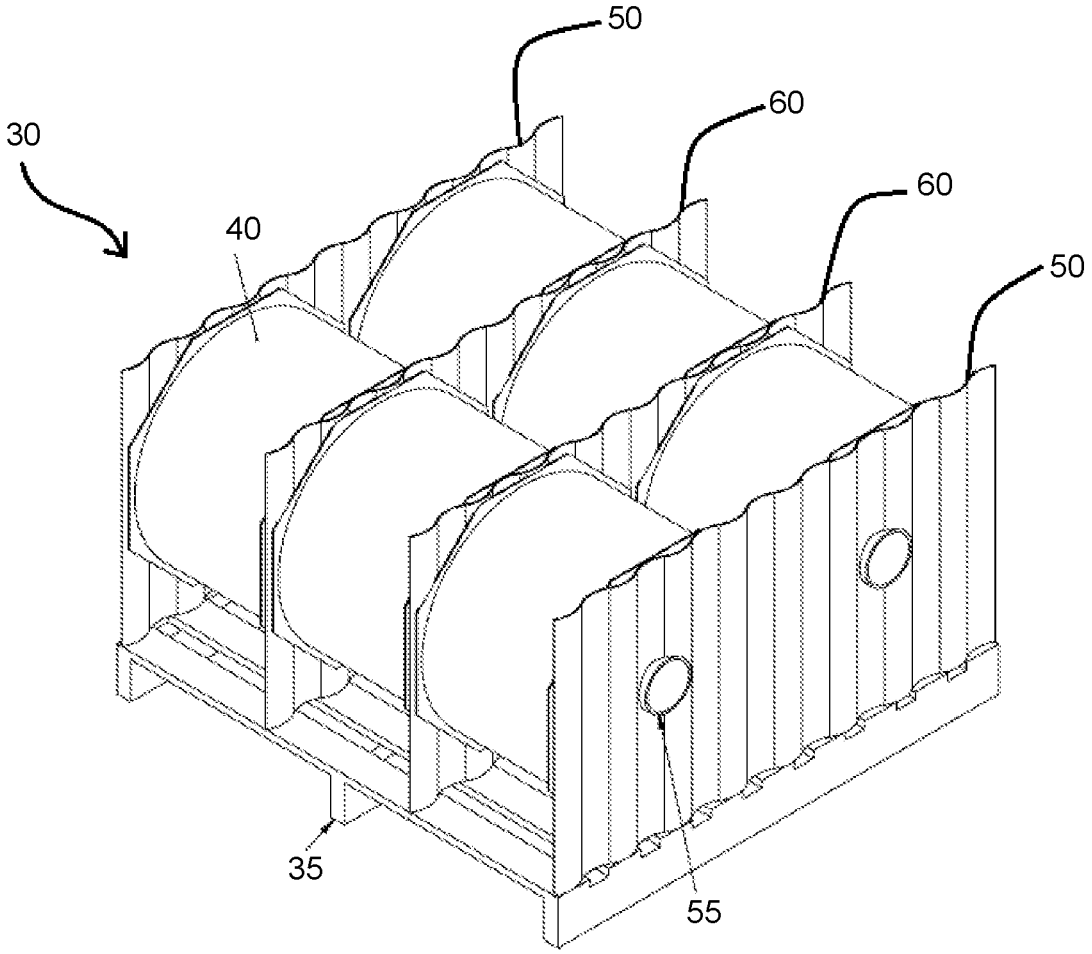
FIG. 3 is a side perspective view of a carton or package of container carriers according to one preferred embodiment of this invention.

In a preferred embodiment of the invention shown in FIG. 3, package 30 comprises a carton or at least two or more rigid sidewalls 50. The carton may contain two or more reels 40 of container carriers 10. A method for assembling package 30 of container carriers 10 is required that results in an efficiently filled package 30 and permits uninterrupted removal of a mostly continuous elongated strip of container carriers 10. In one preferred embodiment of this invention, package 30 is loaded with multiple reels 40 of container carriers 10. Preferably, though not necessarily, each reel 40 of container carriers 10 is separated and/or positioned using one or more dividers 60 to maintain position of and spacing between the various reels 40 of container carriers 10. This configuration helps prevent tangling and other problems encountered during loading and unloading of package 30.

A system for dispensing a generally continuous string 10 of container carriers includes a base 35. The base 35 may comprise a standard pallet or may be specifically adapted to the system herein.

At least two rigid sidewalls 50 preferably extend from the base 35. The rigid sidewalls 50 may comprise corrugated load bearing cardboard or similar construction. Additional sidewalls may extend between the two rigid sidewalls 50 that may be less structural but serve to protect the contents from contamination or intrusion. Alternatively, a carton may be formed of four similar sidewalls, each forming a structural rigid support for the system.

One or more axles 55 may extend between the rigid sidewalls 50. The axles 55 may comprise thick wall cardboard tubes or may comprise a more rigid and reusable solution including steel, plastic or other suitable material that can support the substantial weight of two or more reels 40 of container carrier.

At least two reels 40 are preferably positioned around each axle 55. The reels 40 as described each include a string 10 of container carriers. During production, the container carriers are preferably formed, such as through a punch press or rotary die, into generally continuous strings that are wound onto the reels 40 and then positioned within the subject system. Adjacent reels 40 are preferably are spliced together, so that a tail of reel A is connected to a head of reel B to form a generally continuous string 10 of container carriers.

Figure 4:
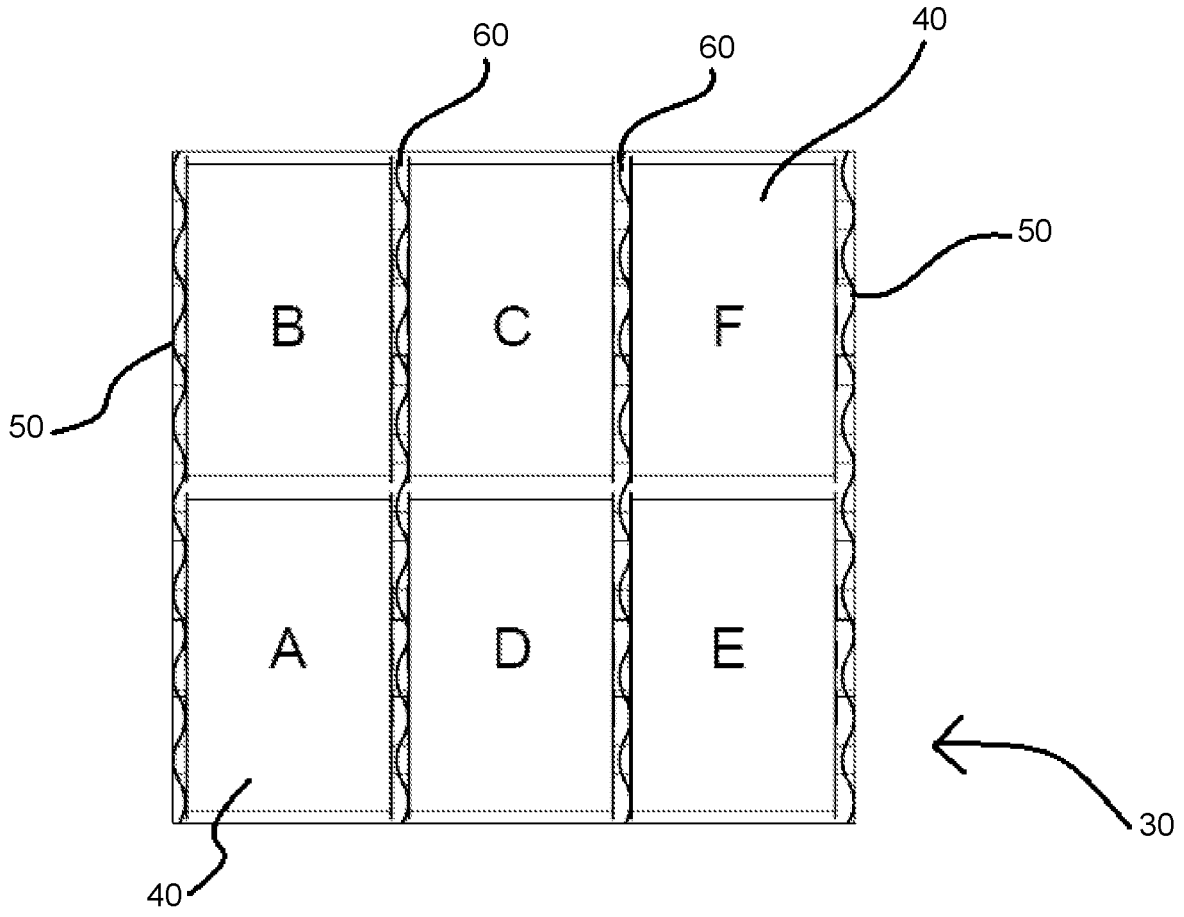
FIG. 4 is a planogram of a carton or package of container carriers according to one preferred embodiment of this invention.

In a preferred embodiment of this invention, each additional reel 40 of container carriers 10 that is added to package 30 is connected to the previous reel 40 of container carriers 10. Preferably, an end or tail of a container carrier at a bottom of a first reel 40 of container carriers 10 is connected with a head or beginning container carrier at a top of an additional reel 40 of container carriers 10. The end container carrier is preferably connected or spliced with the beginning container carrier using a weld attachment or a heat seal. A planogram showing a preferred arrangement of reels 40 is shown in FIG. 4. Adjacent reels 40 of container carriers 10 may also be connected using other methods known to those having skill in the art.

Specifically, the system preferably comprises an array of reels 40, each reel 40 of the array including a string of container carriers spliced to a string of container carriers of at least one adjacent reel 40, such as shown in FIGS. 3 and 4.

In this specific embodiment, six reels 40 may be arranged in two rows, wherein two reels 40 along one rigid sidewall 50 include a spliced connection relative to each other and two reels 40 along another rigid sidewall include a spliced connection relative to each other. Further, the two reels 40 in a center of the axle 55 include a spliced connection relative to each other. As shown in FIG. 4, a preferred arrangement includes connections among Reels A-B-C-D-E-F in that order head-to-tail. This arrangement encourages continuous runoff without tangling or interruption.

In a preferred embodiment, each reel 40 is preferably fully "back wrapped" to enable continuous head-tail splicing. Specifically, each reel 40 is manufactured so that a mid-point of the carrier length is folded and wound at a core of the reel 40 so each turn of the reel pays off the length going to the application machine and a length to be pulled to the machine after the first half of the reel is depleted.

The system may further include a divider 60 positioned between each adjacent reel 40. The divider 60 may be positioned specifically between each adjacent reel that shares a common axle 55 and may prevent binding between the reels as they are unwound. Like the sidewalls 50, the dividers 60 may also be corrugated cardboard and assist in the structural integrity of the system.

In one embodiment, an additional layer of reels 40 may be positioned on top of the plurality of reels 40. In this arrangement, at least one reel 40 of container carriers in the additional layer of reels is spliced to at least one reel 40 of container carriers in the plurality of reels below.

Figure 5:
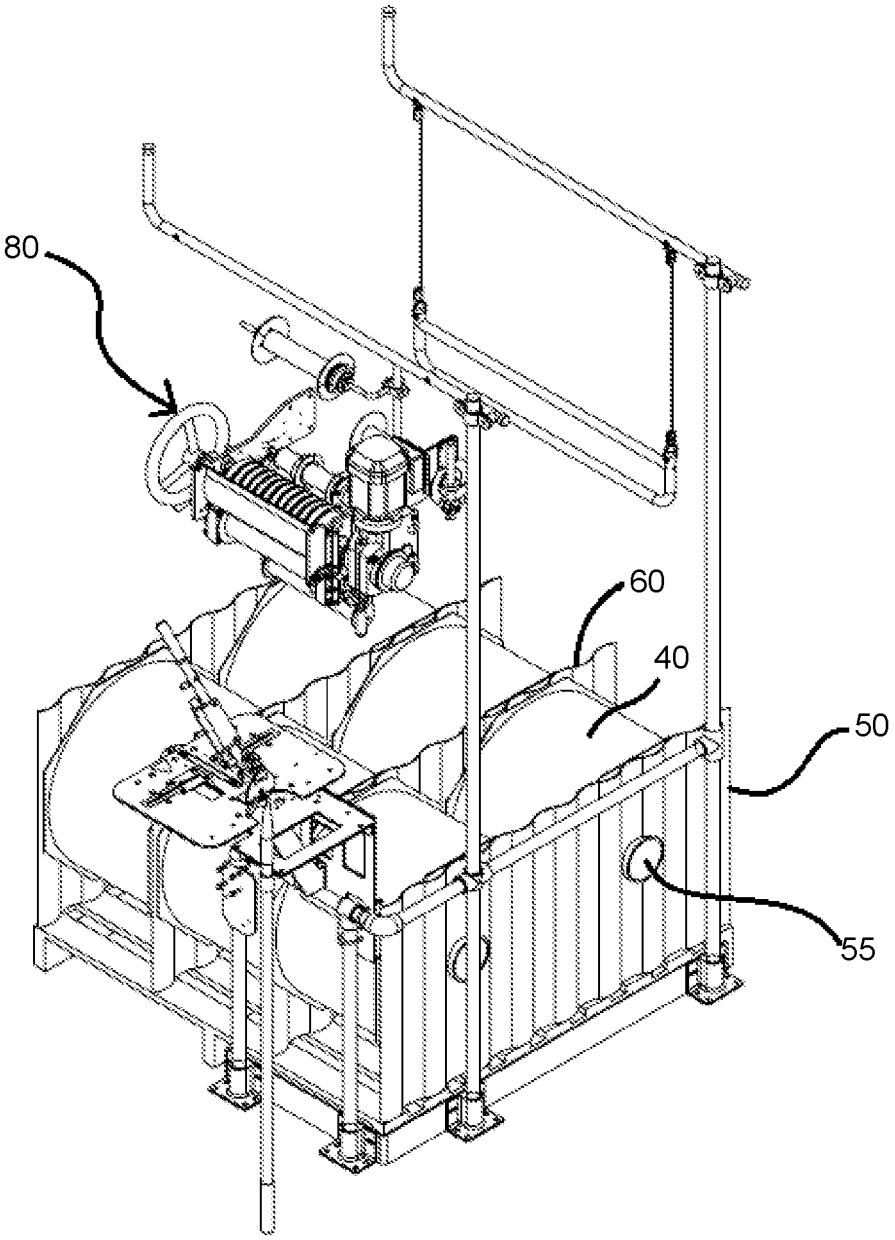
FIG. 5 is a side perspective view of a carton or package of container carriers and a payoff system according to one preferred embodiment of this invention.

According to one embodiment shown in FIG. 5, a payoff system 80 may be integrated with the subject system to provide a powered pull system. The payoff system 80 according to this invention preferably pulls material from the reel 40 at a rate matched to a speed of the application machine. Such a powered feed system preferably acts as an isolation mechanism for the flow of carrier. As a result, the powered feed or pull system would keep upstream or downstream changes in tension from effecting proper application of the carrier to containers.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

The invention claimed is:

1. A system for dispensing a generally continuous string of container carriers, each container carrier for unitizing a plurality of containers, the system comprising:

a base;

two rigid sidewalls extending from the base;

an axle extending between the rigid sidewalls; and at least two reels positioned around the axle, each reel including a string of container carriers that are spliced together to form a generally continuous string of container carriers, wherein each reel is back-wrapped.

2. The system of claim 1 wherein the at least two reels comprise an array of reels, each reel of the array including the string of container carriers spliced to another string of container carriers of at least one adjacent reel of the array to form the generally continuous string of container carriers.

3. The system of claim 1 comprising an additional two axles, each axle supporting at least two reels.

4. The system of claim 1 comprising a divider positioned between each adjacent reel of the at least two reels.

5. The system of claim 1 comprising a divider positioned between each adjacent reel of the at least two reels that are positioned around the axle and that share that axle.

6. The system of claim 1 wherein the rigid sidewalls form a portion of a carton containing the generally continuous string of container carriers.

7. The system of claim 1 further comprising at least additional sidewalls forming a carton.

8. The system of claim 1 comprising six reels arranged in two rows, wherein two reels of the six reels along one rigid sidewall of the two rigid sidewalls include a spliced connection and two reels of the six reels along the other rigid sidewall of the two rigid sidewalls include a spliced connection.

9. The system of claim 8 wherein two reels of the six reels in a center of the axle include a spliced connection.

10. The system of claim 1 wherein the rigid sidewalls are corrugated.

11. The system of claim 1 wherein the axle comprises a cardboard tube.

12. The system of claim 1 wherein an additional layer of reels is positioned on top of the at least two reels.

13. The system of claim 12 wherein at least one reel of container carriers in the additional layer of reels is spliced to at least one reel of container carriers in the at least two reels below.

14. A generally continuous string of container carriers, each container carrier for unitizing a plurality of containers, the generally continuous string of container carriers comprising:

a first reel having a string of container carriers;

a second reel having a string of container carriers, the second reel connected to the first reel with a splice, wherein the first reel and the second reel are back-wrapped;

an axle supporting at least one of the first reel and the second reel; and at least two sidewalls enclosing the first reel and the second reel.

15. A package of container carriers comprising:

a carton;

a generally continuous string of container carriers rolled onto a plurality of reels in a generally continuous fashion wherein adjacent reels are separated by a splice, wherein an additional layer of reels is positioned on top of the plurality of reels, and wherein at least one reel of container carriers in the additional layer of reels is spliced to at least one reel of container carriers in the plurality of reels below.

16. The system of claim 14 wherein each reel is back-wrapped.

17. The package of claim 15 further comprising a pair of axles, each axle supporting two or more reels of container carriers.

18. The package of claim 17 further comprising a divider positioned between each adjacent reel on an each axle.

19. The package of claim 17 further comprising a pair of sidewalls between which each axle extends.

20. The package of claim 15 wherein the plurality of reels are arranged in a two by three array of reels within the carton.

21. A system for dispensing a generally continuous string of container carriers, each container carrier for unitizing a plurality of containers, the system comprising:

a base;

two rigid sidewalls extending from the base;

at least one axle extending between the rigid sidewalls; and six reels arranged in two rows, wherein two reels of the six reels along one rigid sidewall of the two rigid sidewalls include a spliced connection and two reels of the six reels along the other rigid sidewall of the two rigid sidewalls include a spliced connection, wherein at least two reels are positioned around the at least one axle, each reel including a string of container carriers that are spliced together to form a generally continuous string of container carriers.

* * * * *